US005884365A

United States Patent [19]

Klüting

[11] Patent Number: 5,884,365

[45] Date of Patent: Mar. 23, 1999

[54] DOOR HINGE FOR A MOTOR VEHICLE DOOR

[75] Inventor: Bernd-Alfred Klüting, Radevormwald, Germany

[73] Assignee: ED. Scharwächter GmbH & Co. KG, Remscheid, Germany

[21] Appl. No.: 833,778

[22] Filed: Apr. 9, 1997

[30] Foreign Application Priority Data

May 6, 1996 [DE] Germany ..... 196 18 091.0

[51] Int. Cl.[6] ..... E05D 5/10; E05D 5/12; E05D 7/10

[52] U.S. Cl. ..... 16/257; 16/262; 16/263; 16/380; 16/386

[58] Field of Search ..... 16/254, 257, 259, 16/261–263, 380, 386

[56] References Cited

U.S. PATENT DOCUMENTS

| | | | |
|---|---|---|---|
| 1,920,446 | 8/1933 | Haskins et al. | 16/386 |
| 4,675,940 | 6/1987 | Brockhaus | 16/386 |
| 5,033,163 | 7/1991 | Kaibuki et al. | 16/386 |
| 5,577,295 | 11/1996 | Papke et al. | 16/386 |

FOREIGN PATENT DOCUMENTS

| | | | |
|---|---|---|---|
| 2353370 | 5/1975 | Germany | 16/274 |
| 3609820 | 10/1986 | Germany | 16/386 |

*Primary Examiner*—Chuck Y. Mah
*Assistant Examiner*—Donald M. Gurley
*Attorney, Agent, or Firm*—Anderson, Kill & Olick, P.C.

[57] ABSTRACT

A separable door hinge for a motor vehicle door including two hinge halves attachable, respectively, to a door and a door pillar, at least partially retractable hinge pin for connecting the two hinge halves, with the hinge pin having a first portion provided with a circumferential knurling for engaging a wall of a gudgeon bore of a gudgeon of one of the two hinge halves for fixedly securing the hinge pin against rotation in a finally assembled condition of the door, and a second portion extending, in the finally assembled condition of the door, into a gudgeon bore of a gudgeon of another of the two hinge halves, with a running fit, and a radially resiliently deformable sleeve supported on the hinge pin without a possibility of axial displacement on a third portion of the hinge pin associated with the one of the two hinge halves.

4 Claims, 2 Drawing Sheets

DOOR HINGE FOR A MOTOR VEHICLE DOOR

BACKGROUND OF THE INVENTION

1. Field of the Invention

The present invention relates to a separable door hinge for a motor vehicle door and including two hinge halves, attachable, respectively, to a door and an associated door pillar, at least partially retractable hinge pin for connecting the two hinge halves for pivotal movement relative to each other and for separation from each other, with the hinge pin having a first portion provided with a circumferential knurling for engaging a wall of a gudgeon bore of a gudgeon of one of the two hinge halves for fixedly securing the hinge pin against rotation in a finally assembled condition of the door and a second portion extending into a gudgeon bore of one gudgeon of another of the two hinge halves with a running fit.

2. Description of the Prior Art

Separable door hinges of the above-described type are well known and are widely used. There exist many different embodiments of the above-described type of a door hinge. Generally, during a preliminary assembly of the door, a portion of the hinge pin stud is pressfitted in a gudgeon of one of the two hinge halves, with the hinge pin knurling engaging the wall of the gudgeon of the one of the two hinge halves in a finally assembled condition of the door. In one of the conventional embodiments of a door hinge, in which one of the hinge halves has two spaced gudgeons between which a fork-shaped gudgeon of another of two halves is received, the hinge pin is completely withdrawn and then, during the final assembly, is inserted again. This embodiment of a door hinge has a number of drawbacks resulting from the fact that the parts of motor vehicle door hinges are mass-produced. From the mass-production of the door hinge components necessarily follows that the hinge halves and hinge pins are separate parts, are produced with small tolerances, and are assembled together without considering tolerance pairing. The danger of the use of conventional mass-produced door hinges consists in that in a relatively large number of door hinges, maximum permissible tolerances of the hinge pin and a gudgeon bore both positive any negative would coincide, resulting in significantly different forces of insertion and withdrawal of the hinge pin. This causes significant problems in vehicle assembly lines. Another problem, which is associated with the use of door hinges with a completely retractable pin, consists in that it cannot be insured that during the final assembly of the door, the original hinge pin would be inserted in the hinge, so that the tolerance pair of the hinge pin and the gudgeon bore may change during the final assembly of the door.

More favorable results are achieved with the use of another embodiment of the door hinge in which the hinge pin is not completely withdrawn during the temporarily lifting off of the door. In this embodiment, the hinge pin is only partially extracted during lifting of the door with a result that after the two hinge halves are separated, the hinge pin remains engaged in a gudgeon bore of one of the hinge halves. This insures that a hinge pin associated with a particular door hinge is always connected with the door hinge. That permits to avoid additional tolerance problem during re-assembly of the door. However, all of the problem, which are associated with mass production of the door hinges, in particular unfavorable tolerance deviations between a hinge pin and a gudgeon bore still remain.

Accordingly, an object of the present invention is to improve the separable motor vehicle door hinges in such a way that the insertion and pulling forces for insertion and retraction of a hinge pin during preliminary assembly are independent of all possible tolerance pairings of a hinge pin and a gudgeon bore.

Another object of the present invention is to reduce the manufacturing and assembly costs of production of the motor vehicle door hinges.

SUMMARY OF THE INVENTION

These and other objects of the present invention, which will become apparent hereinafter, are achieved by providing in a door hinge of the above-described type a radially resiliently deformable sleeve supported on the hinge pin without a possibility of axial displacement, the sleeve being supported on a third portion of the hinge pin associated with the one of the two hinge halves.

The sleeve is deformed when a predetermined force is applied to the pin to effect the displacement of the pin, insuring a constant uniform force connection between the hinge pin and the gudgeon bore and, thereby, uniform insertion and retraction forces acting during the insertion and extraction of the hinge pin. This is accomplished with very little expenses and permits to eliminate or at least substantially reduce the difficulties resulting from the variation of the insertion and withdrawal forces from hinge to hinge, which occurs during lifting off and re-assembly of motor vehicles doors in motor vehicle production lines. The use of a radially resiliently deformable sleeve permits to overcome a non-foreseen tolerance pairing in separate hinges during the door lifting off and re-assembly. All of the above advantages of using a radially resiliently deformable sleeve results from the fact that the sleeve is deformed in a radial direction under application of an entirely definite force.

According to a preferred embodiment of the present invention, it is contemplated that one of the two hinge halves has two outer, spaced from each other, gudgeons, and wherein the gudgeon of another of the two hinge halves is formed as a middle gudgeon insertable between the two gudgeons of one of the two hinge halves, the hinge pin, in the finally assembled condition of the door, extending through all three gudgeons.

According to a yet more preferred embodiment of the present invention, it is contemplated that the circumferential knurling and the radially resiliently deformable sleeve are spaced from each other a distance corresponding to the distance between the two spaced gudgeons of the one hinge half so that either the circumferential knurling or the sleeve engages a wall of a respective one of the gudgeons. The advantage of spacing the knurling and the sleeve a distance corresponding to the distance between the two spaced gudgeons consists in that the hinge pin in both in the separate position of the hinge halves and in the pre-assembled position of the hinge halves is secured in one or the other gudgeon of the respective hinge half with a constant force, completely independent of a possible tolerance pairing of the hinge pin and the gudgeon bore.

To prevent an axial displacement of the radially resiliently deformable sleeve relative to the hinge pin, the hinge pin is advantageously provided with a circumferential groove for receiving the sleeve. The groove is provided in the hinge pin stud section associated with the gudgeon in which the sleeve is engageable. Alternatively, the radially resiliently deformable sleeve can be located in the respective gudgeon of the respective hinge half, preferably fixedly secured in the gudgeon.

According to the preferred embodiment of the present invention, the radially resiliently deformable sleeve is formed of a substantially smooth annular part and an undulated washer which are connected with each other, and has a axially extending slit. The advantage of mounting such a sleeve on a hinge pin consists in that with the completely inserted pin, the sleeve prevents the pin from displacement in axial direction. This permits to eliminate previously used means for preventing the pin axial displacement.

The undulated washer can be arranged either inside or outside of the annular part. When the annular part is located outside of the undulated washer, the annular part is formed as smooth cylindrical shell. When the annular part is located inside of the undulated washer, it is provided that both ends of the annular part overlap each other in the region of the axial slit, which facilitate mounting of the sleeve on the hinge pin.

According to the most preferred embodiment of the present invention at least one and, preferably, both of the undulated washer and the annular part taper toward the end surfaces of the sleeve.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1A:
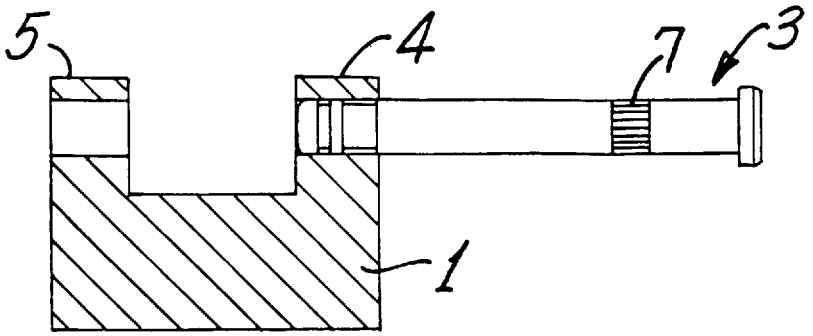
FIGS. 1*a*–1*d* show schematic views illustrating process steps of mounting of a vehicle door by using a separable door hinge according to the present invention, which is separated by extraction of the hinge pin.
Figure 1B:
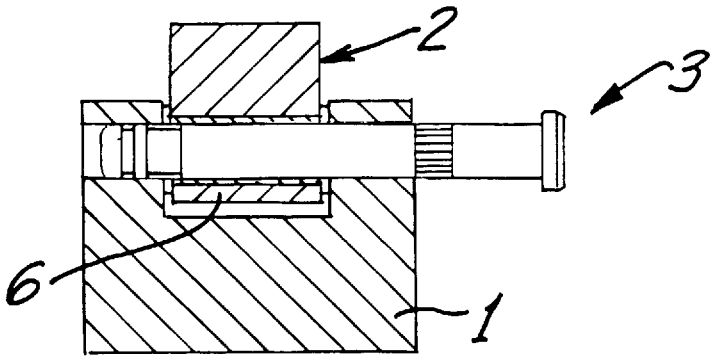
Figure 1C:
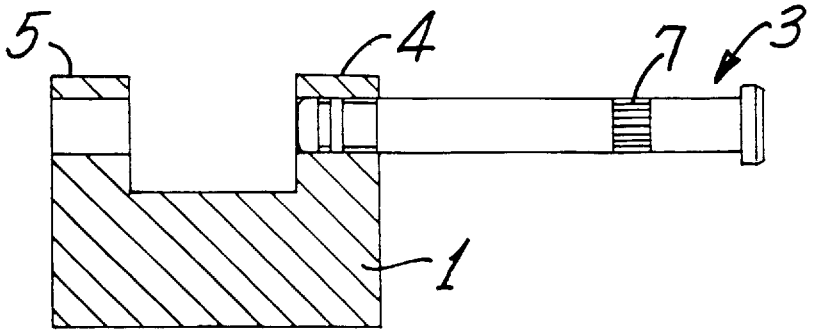
Figure 1D:
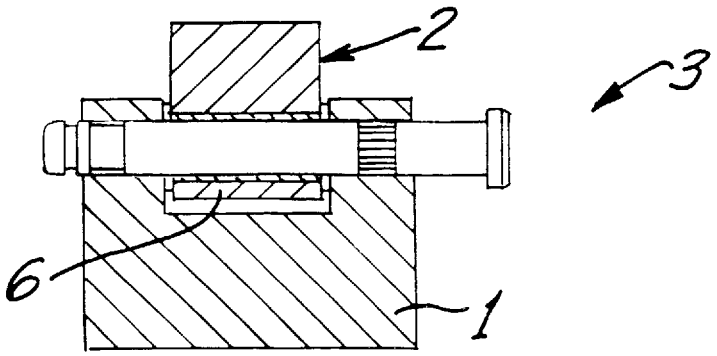

During manufacturing of motor vehicles, motor vehicle doors are first fitted on a vehicle body, are varnished together with the vehicle body, then they are taken off the vehicle body, are appropriately trimmed and, finally, are again mounted on the vehicle body in their originally defined position. When a separable door hinge, which is separated by at least a partial extraction of the hinge pin, is used then during the fitting of a door, both hinge halves 1 and 2 of each door hinge remain, respectively, on a respective part of the door assembly (not shown), the door and the door pillar, and are preliminary and separably connected with each other by the insertion of the hinge pin 3. As shown in FIG. 1*a*, the hinge pin 3 remains in the gudgeon bore of one of two gudgeons 4 and 5 of the first hinge half 1. During the fitting of the door, the middle gudgeon 6 of the second hinge half 2 is inserted between the gudgeons 4 and 5 of the first hinge half 1, and the hinge pin 3 is passed through the gudgeon 6 and into the other of the two gudgeons 4 and 5 of the first hinge half 1, as shown in FIG. 1*b*. Thereby, a vehicle door is brought into its pre-assembly position. For temporarily lifting off of the door, the hinge pin 3 is withdrawn to its separating position, as shown in FIG. 1*c*, and then, during the final assembly of the door, is again inserted through the gudgeon 6 of the second hinge half 2 and into the second gudgeon 5 of the first hinge half 1, as shown in FIG. 1*d*. The hinge pin 3 has a circumferential knurling 7 which, when engaging a wall of the gudgeon bore of one of the gudgeons 4 and 5 of the first hinge half 1, secures the hinge pin 3 against both a rotation about the longitudinal axis of the pin 3 and against displacement in the axial direction.

Figure 2:
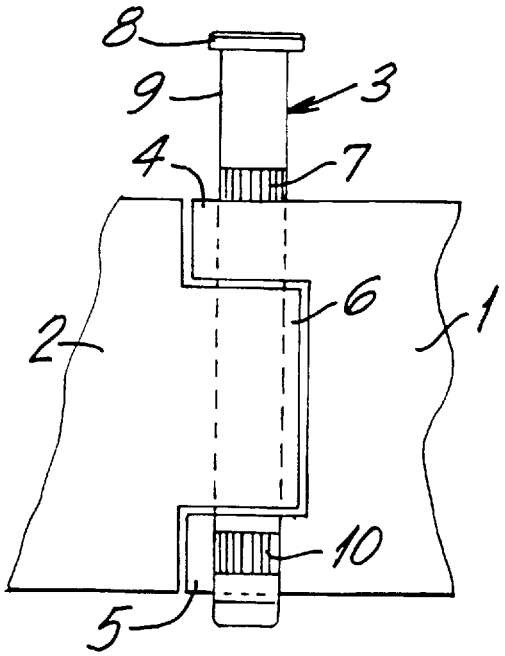
FIG. 2 shows a side view of a separable door hinge according to the present invention in a pre-mounting position of the hinge pin.
Figure 3:
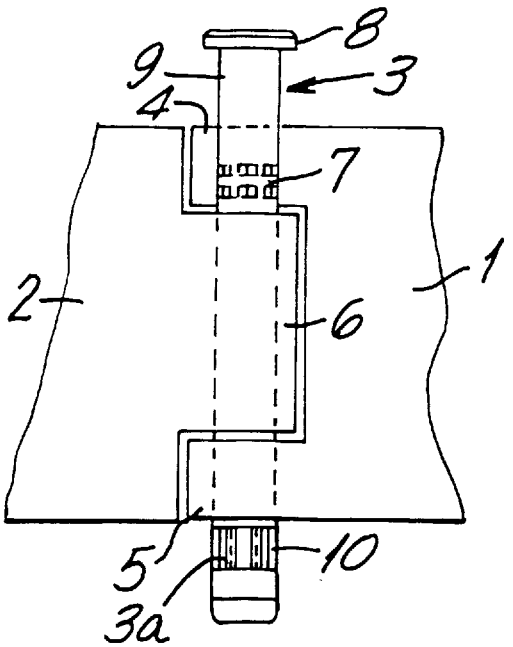
FIG. 3 shows a side view of a separable door hinge according to the present invention in a post-mounting position of the hinge pin.

The circumferential knurling 7 is provided on the stud portion 9 of the hinge pin 3 at some distance from the hinge pin head 8. The knurling 7 form-lockingly engages the wall of the gudgeon bore of the gudgeon 4 of the first hinge half 1, thereby preventing the hinge pin 3 from rotational and axial displacement. In the embodiment of the hinge pin 3, which is shown in the drawings, the hinge pin 3 has, at a certain distance from the knurling 7, an annular groove 3*a* in which a sleeve 10, which is resiliently deformable in the radial direction, is located. The sleeve-receiving groove 3*a* is provided at such a distance from the knurling 7 that either the radially resiliently deformable sleeve 10 engages the wall of the gudgeon bore of the second gudgeon 5 of the first hinge half 1 during the pre-assembly of the door, or the knurling 7 engages the wall of the gudgeon bore of the first gudgeon 4 of the first hinge half 1 during the final assembly of the door when the sleeve 10 is located outside of the gudgeon bore of the gudgeon 5, as shown in FIGS. 2 and 3, respectively. In the final assembly position, the sleeve 10 is in unstressed position, and an end surface of the sleeve 10 abuts an outer surface of the second gudgeon 5 of the first hinge half 1 and provides for securing the hinge pin 3 against displacement in axial direction. As shown in FIGS. 2 and 3, the gudgeon bores have smooth cylindrical surfaces. The gudgeon 6 of the second hinge half 2 is formed as a collar sleeve of a maintenance-free bearing material through which the smooth section of the hinge pin stud extends with a running fit.

Figure 4A:
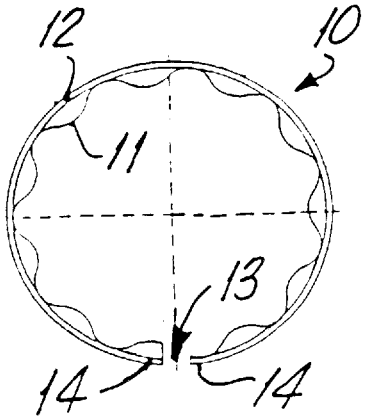
FIG. 4*a* shows a plan view of first embodiment of a resilient, elastically deformable sleeve according to the present invention.
Figure 4B:
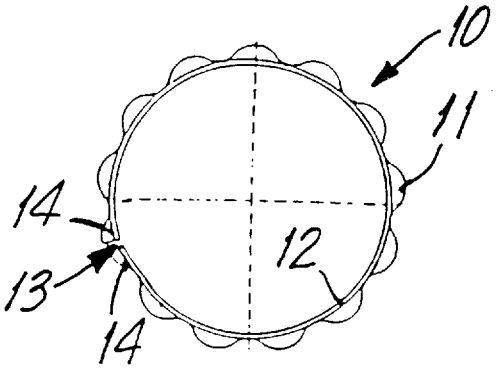
FIG. 4*b* shows a plan view of a second embodiment of a resilient, elastically deformable sleeve according to the present invention.

As shown in FIG. 4, the radially resiliently deformable sleeve 10 is formed of a smooth cylindrical annular member 13 and an undulated washer 12 connected with each other. The sleeve 10 has an axial slit 14. The slit 14 is so formed that opposite surfaces of the sleeve 10, which define the slit 14, tightly engage each other before the sleeve 10 is mounted on the hinge pin 3.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A separable door hinge for a motor vehicle door, comprising:

two hinge halves attachable, respectively, to a door and a door pillar;

at least partially retractable hinge pin for connecting the two hinge halves for pivotal movement relative to each other and for separation from each other, the hinge pin having a first portion provided with a circumferential knurling for engaging a wall of a gudgeon bore of a gudgeon of one of the two hinge halves for fixedly securing the hinge pin against rotation relative to the one of the two hinge halves in a finally assembled condition of the door, and a second portion extending into a gudgeon bore of a gudgeon of another of the two hinge halves with a running fit; and a radially resiliently deformable sleeve formed of a substantially smooth annular part and an undulated washer having an axially extending slit, the deformable sleeve being supported on the hinge pin, the sleeve being supported on a third portion of the hinge pin associated with the one of the two hinge halves, the hinge pin having means for preventing an axial displacement of the sleeve, wherein one of the two hinge halves has two outer, spaced from each other, gudgeons, and the gudgeon of another of two hinge halves is formed as a middle gudgeon insertable between the two gudgeons of the one of the two hinge halves, the hinge pin, in the finally assembled condition of the door, extending through all three gudgeons, and wherein the circumferential knurling is associated with one of the two gudgeons of the one of the two hinge halves, and the radially resiliently deformable sleeve is associated with another of the two gudgeons of the one of the two hinge halves, the knurling and the sleeve being spaced from each other a distance corresponding to a distance between the two gudgeons of the one of the two hinge halves so that only one of the knurling and the sleeve cooperates with a respective gudgeon in a pre-assembled condition of the door.

2. A door hinge as set forth in claim 1, wherein the preventing means comprises an annular groove for receiving the radially resiliently deformable sleeve.

3. A door hinge as set forth in claim 1, wherein the undulated washer is arranged externally of the annular part, and the annular part is formed as a shell having smooth surfaces and engaging the undulated washer from inside.

4. A door hinge as set forth in claim 1, wherein the annular part is formed as a shell having a smooth surface, and the undulated washer is arranged internally of the annular part engaging the annular part from inside.

* * * * *